US005254065A

United States Patent [19]

Pollock

[11] Patent Number: 5,254,065

[45] Date of Patent: Oct. 19, 1993

[54] FLEXIBLE LOOP FASTENING STRAP SUPPORTABLE IN DOOR STRUCTURE

[76] Inventor: Todd E. Pollock, 3216 W. 21st, Spokane, Wash. 99204

[21] Appl. No.: 808,215

[22] Filed: Dec. 16, 1991

[51] Int. Cl.[5] ..... A63B 21/04

[52] U.S. Cl. ..... 482/129; 482/904

[58] Field of Search ..... 482/129, 904, 148; 182/189, 190, 191; 248/214

[56] References Cited

U.S. PATENT DOCUMENTS 3,256,015 6/1966 Perrin ..... 482/129
4,779,867 10/1988 Hinds ..... 482/904
5,100,129 3/1992 Porter et al. ..... 482/129

*Primary Examiner*—Stephen R. Crow
*Attorney, Agent, or Firm*—Keith S. Bergman

[57] ABSTRACT

A fastening strap configured as a loop is securable between a door and its associated frame to provide structure for attachment of exercise or physical therapy equipment to the door structure for support. The fastening strap is formed from a flexible elongate strip of webbing with an enlarged end portion which in a first species comprises a rolled portion of the first end portion of the webbing material and in a second species is a separate resiliently deformable element. The webbing strip extends from the enlarged end portion to form a loop and pass back over the enlarged end portion for fastening of the second end to the loop portion of the strip. The second end and adjacent the strips forming the loop are fastened to each other spacedly adjacent the enlarged end portion. A flexible coating is provided on a portion of the outer surface of one strip portion forming the loop to provide a higher frictional surface to contact a supporting door structure and to protect the strip from physical damage from the supporting door structure.

6 Claims, 2 Drawing Sheets

FIG. 1
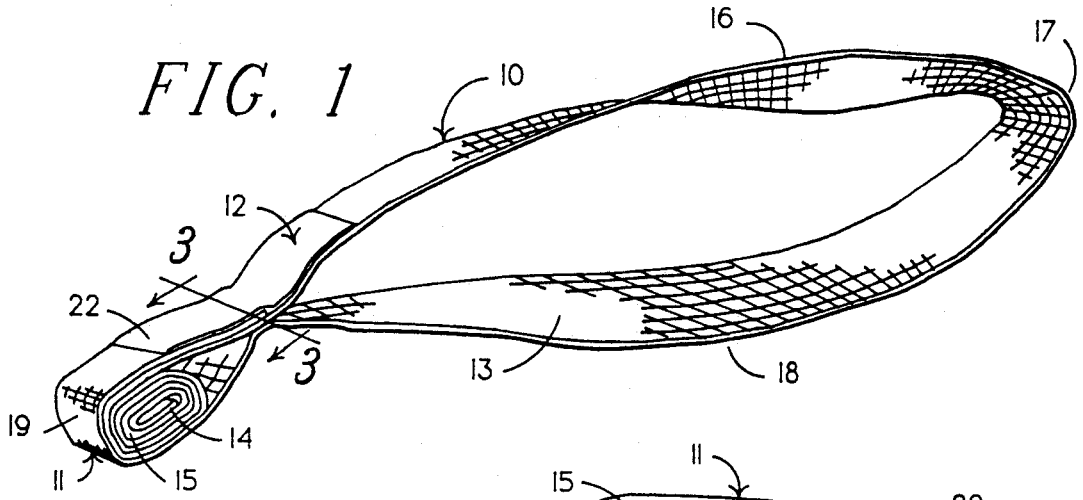
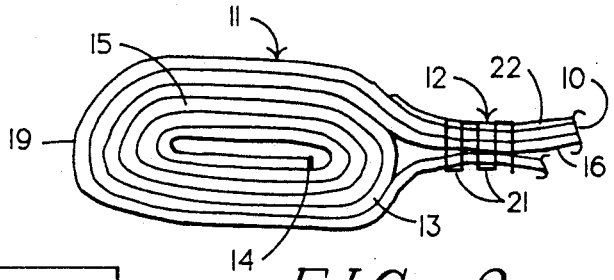
FIG. 2
FIG. 4
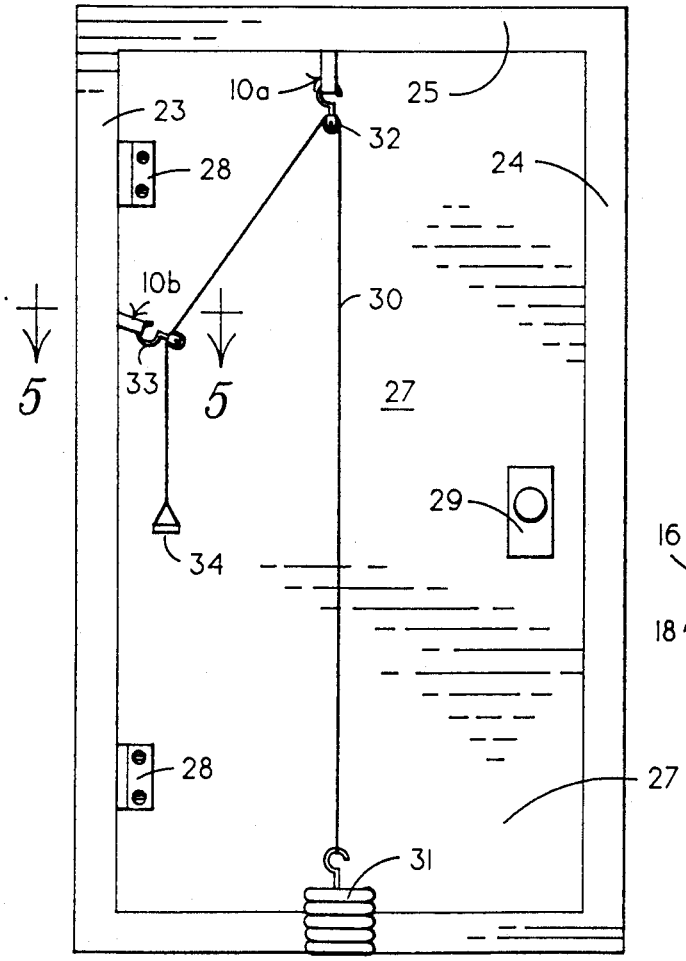
FIG. 3
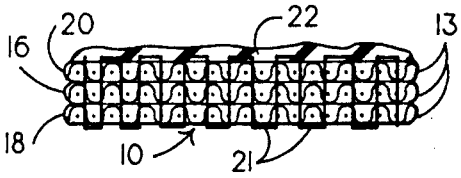

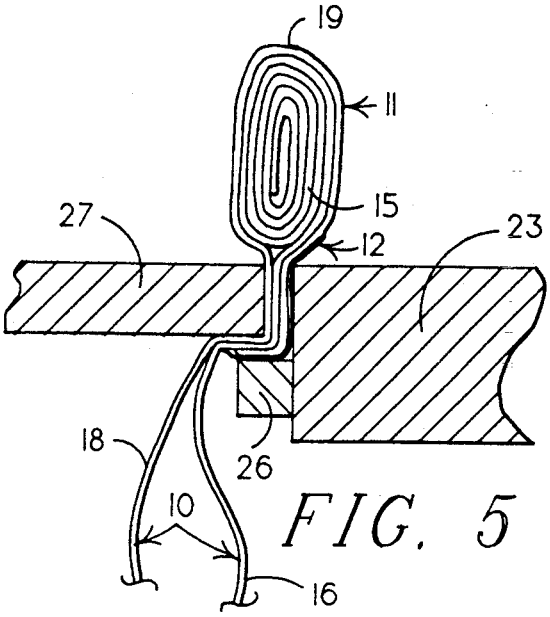
FIG. 5
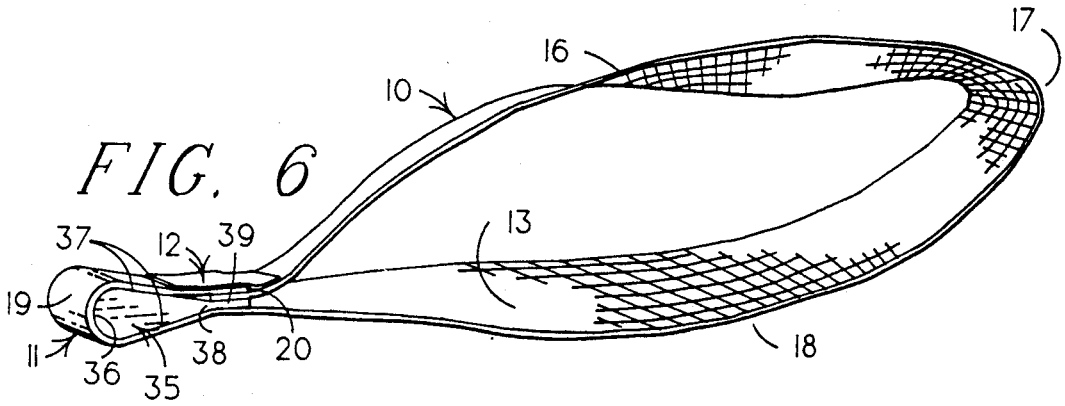
FIG. 6
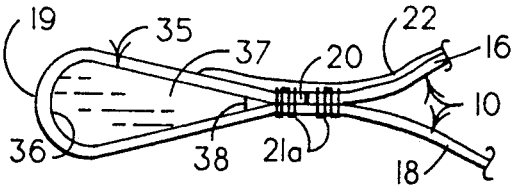
FIG. 7
FIG. 8
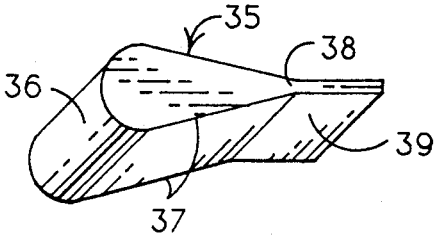

FLEXIBLE LOOP FASTENING STRAP SUPPORTABLE IN DOOR STRUCTURE

BACKGROUND OF INVENTION

1. Related Applications

There are no applications related hereto heretofore filed in this or any foreign country.

2. Field of Invention

This invention relates generally to loop type fastening straps releasably engageable in a door structure to support exercise apparatus and more particularly to such a strap that has an enlarged end portion and higher friction surface coating on a portion of one surface to aid its functioning.

BACKGROUND AND DESCRIPTION OF PRIOR ART

Strap type fastener structures engaged between a door and its associated frame have heretofore been known and have become popular of use to support exercise systems, especially those of a portable type. Commonly such fastening structures have one enlarged end so that the fastening structure may be placed between a door and its frame with the enlarged end portion on one side and the fastening portion on the opposite side of a door structure so that the enlarged end is unable to pass through the space between a door and door frame when tension is applied to the fastening strap.

Known fastening straps generally have not disclosed structure to prevent the portion of the fastening strap carried between a door and door frame from slipping, especially up or down, relative to that support structure when tension is applied to the fastener during placement and use. Any slippage tends to reposition supported exercise or physical therapy equipment, often into a less desirable location and sometimes even injuring of a user. The instant invention provides a polymeric coating on a part of one side of the fastening strap surface that contacts a door structure to enhance frictional contact between the strap and door structure for more secure positional maintenance. The coating material is relatively thin and flexible so as to have no deleterious effect on the other normal characteristics of the fastening strap.

Prior fastening straps have not satisfactorily addressed the problem of reducing wear and physical degeneration to the portion of strap carried between a door and its frame. The use of exercise equipment by its nature results in stresses and strain on fastening straps which causes wear that effects both durability and safety. The polymeric coating on my strap not only has the added advantage of protecting the strap surface, but also reduces motion of the fiber elements in the strap itself and of the strap relative to a supporting structure, both of which may result in damage to the strap over a period of use.

Prior fastening straps have not disclosed means to adequately protect stitching or similar fastening structure about an enlarged end structure and in the strap portion secured between a door and its frame. Prior devices have used stitching through an enlarged portion or immediately adjacent to it to fasten strap ends and keep the enlarged portion from loosening its structural and positional integrity when tension is applied to the strap. In contradistinction to these prior devices, the instant invention does not provide stitching through an enlarged portion or immediately adjacent to it, but rather brings the loop forming end of the strap back about the enlarged portion so that the end portion of this strap may be secured by stitching at a spaced distance from the enlarged portion. This stitching in my fastening strap is then positioned in the portion of the strap carried between the door and associated frame. The pressure caused by door and door frame squeezes together those portions of the elongate strap therebetween and tends to reduce stress on the stitching while still maintaining the integrity of operation of the enlarged portion.

Additionally in prior devices that used stitching on the part of a strap carried between door and door frame, no adequate means was provided to protect that stitching from abrasion that might occur, especially during strap placement and removal. The instant invention protects the stitching by covering it with the frictional coating material which reduces motion of the stitching in the strap and protects the exposed surface of the stitching against abrasion.

Most prior fastening straps which have had an enlarged end portion provided such enlargement by fastening an end portion of a strap about a separate rigid element or, when formed by a rolled end portion of the strap, fastened that rolled portion in a compact fashion that made the roll quite rigid. Either form of such rigid enlargement was susceptible to substantial wear caused by stresses and strains resulting from normal use which tended to disrupt the enlarged structure and damage the strap and its fastening means, especially by tearing stitching that maintained the enlarged end configuration. My enlarged end structure in contradistinction provides a resiliently deformable somewhat wedge shaped enlargement structure with the strap fastened thereabout by stitching at a spaced distance from the enlarged portion. This structure not only provides fastening contact of the strap with a door structure without stressing the sewn strap portion, but also allows the enlarged portion to assume somewhat of a tear-drop or wedge shape when stressed by fastening forces to provide a more efficient fastening with less wear than would result with rigid enlargements having a strap fastened immediately adjacent thereto.

My invention resides not in any one of these features per se, but rather in the synergistic combination of all of its structures that necessarily give rise to the functions flowing therefrom as herein specified and claimed.

SUMMARY OF INVENTION

The present invention provides a flexible fastening strap securable between a door and its supporting frame for support of exercise or physical therapy equipment. The fastening strap is formed by an elongate strip of webbing having a first end passing from an enlarged end structure to form a loop, with the second end portion encircling back about the enlarged first end portion and spacedly therepast where the second end portion is sewn to the adjacent loop spacedly distant from the enlarged first end portion. Tn a first species, the enlarged end portion is formed by a rolled end portion of webbing material and in a second species is formed by a resiliently deformable, wedge-shape element with the wedge apex facing the loop of the fastening strap. A coating is adhered to an external portion of the strap that will contact a supporting door structure to provide a higher friction surface and protect the strap and its stitching from physical damage.

In providing such a device it is:

A principal object to create a flexible fastening strap that has a resiliently deformable enlarged end portion with the strap passing therefrom to form a loop and passing back around the enlarged end portion for fastening the second strap end to the loop portion spacedly adjacent the enlarged end portion.

A further object is to provide a first species of enlarged end structure that is formed by rolling a first strap end upon itself and a second species that is formed by a separate resiliently deformable wedge shaped structure.

A further object is to provide such a fastening strap that has stitching between the second strap end and the loop portion spacedly adjacent the enlarged end portion to configurationally and positionally maintain the enlarged end portion.

A further object is to provide such stitching in a position on the fastening strap that will be carried between adjacent portions of a supporting door structure to relieve stress on the sewn interconnection when tension is applied to the fastening loop.

A further object is to provide such a fastening strap that has a coating of frictional material on one outer surface of a portion that is carried adjacent to a door structure to protect that surface and provide higher frictional contact with the door structure.

A still further object is to provide such a fastening strap that has a resiliently deformable enlarged end portion that simulates a wedge shape when tensive forces are applied to the loop to aid fastening and lessen wear caused by such forces.

A still further object is to provide such a fastening strap that is of new and novel design, of rugged and durable nature, of simple and economic manufacture and one otherwise well adapted for the uses and purposes for which it is intended.

Other and further objects of my invention will appear from the following specification and accompanying drawings which form a part hereof. In carrying out the objects of my invention, however, it is to be remembered that its accidental features are susceptible of change in design and structural arrangement with only one preferred and practical embodiment being illustrated in the accompanying drawings as required.

BRIEF DESCRIPTION OF DRAWINGS

In the accompanying drawings which form a part hereof and in which the same reference numerals designate the same parts in all views:

FIG. 1 is an isometric surface view of the first rolled end species of my fastening strap showing its various parts, their configuration and relationship.

FIG. 2 is a partial somewhat enlarged elevational view of the enlarged end portion and fastening structure of the strap of FIG. 1.

FIG. 3 is a traverse vertical cross-sectional view through the strap of FIG. 1, taken on the line 3—3 thereon in the direction indicated by the arrows.

FIG. 4 is a somewhat diagrammatic orthographic view showing two of my straps positioned for use in a door structure.

FIG. 5 is a somewhat enlarged partial cross-sectional view the fastened portion of a strap of FIG. 4 and the adjacent door structure, taken on the line 5—5 thereon in the direction indicated by the arrows.

FIG. 6 is an isometric view of the second separate wedge species of my fastening strap.

FIG. 7 is an orthographic side view showing an alternative butt type fastening of the first and second strap ends when used with the separate wedge species of enlarged end structure.

FIG. 8 is a somewhat enlarged isometric view of a separate resilient wedge, removed from the fastening strap structure.

DESCRIPTION OF THE PREFERRED EMBODIMENT

As seen in FIG. 1, my fastening strap provides fastening loop 10 extending from enlarged end portion 11 and carrying frictional coating 12 on an outer surface portion of the loop and adjacent enlarged end portion.

My fastening strap is formed from a single length of flexible webbing. This webbing preferably is formed of woven polymeric fibers of appropriate strength and durability, though other materials having similar physical characteristics are within the scope of my invention. Such webbing is available in the present day marketplace and has heretofore been used for similar purposes of supporting and interconnecting exercise devices and their various parts and elements to each other and with support structures.

The physical parameters of the webbing material are somewhat critical to my invention. The webbing aside from being flexible must be strong enough to support the forces imposed upon it by exercise apparatus and an actively exercising user. The thickness of the webbing must be such as to allow two or three adjacent strap portions to be placed between the edge of a door and its associated door frame, taking into account such resilient deformation as both the webbing and the door structure may have. A woven type webbing material is preferred because the nature of the weave allows some deformation of the material without any substantial damage when it is squeezed between adjacent portions of a door structure. These physical requirements dictate use of webbing material of between one-thirty second (0.079 cm.) and one-sixteenth inch (0.159 cm.) thickness and one-half (1.27 cm.) to three inch (7.62 cm.) width. The fibers from which the webbing is formed preferably are of a polymeric material with a smooth, firm external surface that tends to allow some motion of the webbing fibers relative to each other under pressure or tension and also presents a surface that does not abrade or otherwise wear to the extent of rougher surfaced fibers, especially such as fibers of vegetative or animal origin.

Enlarged end portion 11 of the first species of my fastening strap illustrated in FIGS. 1-3 is formed by rolling first end 14 of webbing 13 upon itself in an elongated spiral fashion, as illustrated, to form somewhat flattened cylindrical roll 15 comprised of a plurality of spirally wound layers of webbing. The diametrical size of this roll is not critical to my invention, but should be sufficient to prevent passage of the roll through a space between a door edge and the adjacent portion of its associated frame which, taking into account stress caused deformation of my roll, requires a minimum minor or shorter diameter of at least approximately one-quarter inch. This roll is preferably formed firmly but not tightly, with each outer layer having surface adjacency with the layer therebeneath, but yet not being so tightly wound as to cause residual stress in the rolled portion.

Fastening loop 10 is formed by extending the webbing 13 passing from the outer surface of roll 15 a spaced distance from the roll to form loop side 16, then turning the webbing back upon itself to form distal loop end 17 and thence extending the webbing back to the roll 15, on the side opposite from that from which the loop material originally extended. Portion 19 of the webbing then passes about the outer surface of roll 15 and in adjacency to the outer surface of loop side 16 a spaced distance from the roll to there terminate in second end 20.

The three thicknesses of webbing spacedly adjacent roll 15 and inwardly adjacent second end 20 are then fastened together to configurationally maintain both fastening loop 10 and enlarged rolled end portion 11. The preferable form of such fastening is by stitching 21 extending in fastening fashion between the three interconnected elements. Such stitching is preferably formed by flexible polymeric fibers, commonly of the same type as the material from which the webbing is formed. This fastening of the three overlapping strap portions relative to each other may be accomplished by other fastening means such as staples, rivets, adhesion or the like, which are within the scope of my invention. If rigid fasteners are used for the purpose, they tend to be less stable than flexible thread and somewhat movable stitching and tend to cause damage to door structures adjacent thereto. Adhesive type fastening tends to provide a less secure bond than sewing, notwithstanding that by reason of the design of my fastening strap there are no excessive forces tending to separate the adhered surfaces.

The dimensioning of fastening loop 10 is not particularly critical, but ordinarily it is desirable that the loop should not be substantially larger than required to fulfill its fastening purpose. Commonly the length of the loop, with both sides 16, 18 in adjacency, is approximately four (10.16 cm.) to six inches (15.24 cm.) to allow extension from a door side to permit the interconnection of apparatus to be supported.

Frictional coating 12 provides a patch of frictional material 22 carried by webbing second end portion 19, end 20 and the adjacent outer surface of loop side 16. The frictional material commonly extends from the medial portion of roll 15 a spaced distance beyond second end 20 of the webbing to cover stitching 21 and provide some area of coverage on both sides of the stitching, which will be substantially the portion of the fastening strap that is carried between or in contact with a door edge and the associated jamb element of the supporting door frame. The frictional material must be fastened to the outer surface of the webbing and preferably this fastening is accomplished by adhesion of the material itself, though it is possible that fastening may be accomplished by other independent means which are within the scope of my invention.

The frictional material preferably is a polymeric elastomer which is reasonably cohesive but resiliently deformable and has surface frictional characteristics somewhat similar to those of a softer rubber. Such material may be placed in a viscous liquid form and is adhesive to many polymeric fibers so that it attaches to the supporting webbing upon curing. Various such compounds are known in the present day marketplace and are commonly used to provide frictional surfaces on woven fabric to increase its strength, configurational integrity and surface friction. This material has the added advantage of protecting the surfaces of the webbing and the stitching which it covers from physical forces that may cause abrasion or wear, and it also tends to positionally maintain the fibers of the webbing relative to each other and relative to the stitching 21 to increase strength and decrease wear of my fastening strap.

Frictional material 22 normally will be applied in a relatively thin layer as no great thickness of the material is required as a condition precedent to its functioning and any excessive thickness may tend to disrupt the fastening action of the device in a door structure or cause physical harm to the coating.

A second species of enlarged end structure for my invention is shown in FIGS. 6-8. Here the enlargement structure comprises a resiliently deformable wedge 35 encircled by end portion 19 of the strap. The enlargement wedge has a width substantially the same as strap 10 and, as shown in FIG. 8, provides rounded back portion 36 distal from loop end 17 and two similar inwardly tapering sides 37 that form apex 38 proximal to loop end 17. A relatively thin fastening strip 39 may be provided to structurally interconnect with the apex and extend into the loop structure between loop sides 16, 18 to allow fastening of the wedge in the strap structure for positional maintenance as shown in FIG. 6. The fastening strip is optional, however, and may be omitted as shown in FIG. 7, in which case the enlargement wedge may be positionally maintained by adhesion, frictional or other fastening engagement with the strap portion 19 encircling thereabout.

In the second species of enlarged end structure the strap portion 19 may extend over and about the enlargement wedge in the manner described for the first species and as illustrated in FIG. 6. In this configuration, however, if the enlargement wedge has a fastening strip 39 there will be an additional thickness of material to fit between a door edge and its supporting frame, which may occupy too much space. This condition may be remedied by removing one thickness of strap, by not using a fastening strip 39 on the wedge, or by both as shown in FIG. 7. In this configuration, the first strap end 14 does not extend to the enlargement wedge 35, but rather forms a butt joint with the second strip end 20 spacedly adjacent the enlargement wedge and both strap ends are fastened in abutting adjacency to loop side 18 by stitching 21*a*.

Having thusly described my fastening strap, its use and function can be understood particularly with reference to FIGS. 4 and 5.

My fastener is adapted for use with a door structure providing similar spaced vertical hinge jamb 23 and latch jamb 24 interconnected in their upper end portions by top lintel 25. Traditionally each of the door frame elements 23, 24, 25 carry intercommunicating door stop strips 26 against which a door fits when in a closed position in the door frame. Door 27 is supported in the opening defined by the door frame by two or more hinges 28 carried on hinge jamb 23 and attached to the adjacent door edge. Knob 29 and associated latch structure (not shown) are carried by the door edge opposite hinges 28 in the normal fashion of such structures. The clearance or space between the door and the various adjacent door frame elements in common door structures is sufficient to allow placement and use of my invention, but the invention can be used only where such clearance does exist.

Either species of my fastening strap is used by placing it between an edge of door 27 and the adjacent door frame. Most commonly the fastener will be used on the hinge side of a door, though it may be used on the latch side, or the top, and even possibly along the bottom edge, depending upon a particular door construction and dimensioning. The strap is placed by opening the door, inserting the loop portion in the space between the door and adjacent jamb and then shutting the door while the fastening strip is maintained in this position. In placing my fastening loop, the enlarged end portion 11 is maintained immediately outwardly adjacent the surfaces of the door edge and adjacent door frame and preferably, though not necessarily, on the side of the door toward which the door opens. The frictional material 22 is preferably positioned adjacent the door frame so that the door in moving from an opened to closed position will contact the uncoated surface of fastening strap webbing, so that the motion and resultant friction generated by the door motion causes less wear and abrasion than would result on the higher frictional surface. This positional arrangement is illustrated in the cross-sectional view of FIG. 5.

It is to be particularly noted in the described fastening strap positioning that the portion of the strap that will be held in the door structure between the door and adjacent frame elements is that in which stitching 21 exists and that which is covered by frictional material 22. In normal door construction, the fit tolerance of the various door elements will be such that the fastening strap portion carried in the door structure will generally be under some compression by reason of the dimensioning of the door structure, and this tends to enhance the positional maintenance of the strap and to protect it from wear and tear caused by varying forces applied to it during normal use.

It is also to be noted that the enlarged end portion 11 tends to be configurationally maintained by reason of the positioning of the fastening strap in the door structure, and the tensive forces applied to loop portion 10 of the strap will tend to be distributed over some area rather than concentrated at a particular point, by reason of the construction of the strap itself and its positional relationship with the door structure. This action is particularly pronounced in the second species of enlarged end structure.

A typical arrangement of exercise apparatus supported by two of my loops in a door structure is illustrated in FIG. 4. The first loop 10*a* is positioned at the top edge of the door and second fastening loop 10*b* is positioned along the vertical hinge edge. Flexible cord 30 extends from weight 31 upwardly to pulley structure 32 releasably carried by loop 10*a* and thence angularly downwardly to pulley structure 33 supported by fastening loop 10*b*, thence downwardly to handle 34 which may be used by an exerciser (not shown) in traditional fashion. Many other configurational arrangements for support of exercise apparatus are supported by my fastening strap. My fastening strap is not safely operatable unless door 27 is in closed and latched condition, and the door obviously must be maintained in this condition for effective continued use of my fastening straps. The opening of a door while the fastening straps are in use present a hazardous condition that could injure a user and must be guarded against.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. A flexible fastening strap for exercise and physical therapy apparatus that is releasably engageable for support in a door structure having a substantially rectilinear frame defining an orifice wherein a door is mounted at one side by plural hinges for opening and closing, with latching means engageable between the frame and the door side opposite the hingeably supported side, comprising in combination:

an elongate flexible strap with first and second ends having an enlarged first end portion with the first end portion of the strap extending about the periphery of the enlarged end portion and a spaced distance therefrom to form a first loop side and extending back to the enlarged first end portion to form a second loop side, said second end portion of the strap extending back to the enlarged first end portion at the side opposite that from which the first loop side exited from the enlarged first end portion and extending around a portion of the said enlarged first end portion and therepast, adjacent the first loop side, a distance greater than the thickness of a door about the edge of which the fastening strap is to be engaged, the loop portion of said fastening strap having a length to extend between the adjacent surfaces of the periphery of a door and the associated frame supporting the door and a spaced distance therebeyond and thickness to allow the loop to be positioned between the said door and its supporting frame when the door is in closed condition, and said enlarged end portion of the strap being of size sufficient to prevent its passage between opposed portions of the periphery of a door and its associated frame that are to support the fastening strap;

first fastening means spacedly adjacent the enlarged end portion of the strap interconnecting the two loop side portions with each other and second fastening means interconnecting the second end portion of the strap with at least the first loop side; and frictional coating material covering at least a portion of the outer peripheral surface of the second end of the fastening strap, from the enlarged first end portion to the second strap end.

2. The fastening strap of claim 1 wherein the enlarged end portion is formed by rolling the first end of the strap upon itself.

3. The fastening strap of claim 1 wherein the enlarged end portion is formed by a resiliently deformable wedge with the first end portion of the strap extending about the periphery of the wedge and a spaced distance therepast for fastening on the strap body.

4. The fastening strap of claim 1 further characterized by the frictional coating material comprising a flexible elastic polymer having a relatively high frictional surface, substantial coherence and an ability to adhere to the strap.

5. The fastening strap of claim 1 carried in a door structure between the edge of a door and an adjacent door frame, with the enlarged end portion immediately outwardly adjacent a first surface of the door and the fastening loop portion extending spacedly from the second opposite surface of the door.

6. A flexible fastening strap for exercise and physical therapy apparatus that is releasably engageable for support in a door structure having a substantially rectilinear frame defining an orifice spacedly larger than the door, said door being mounted in the orifice for opening and closing by plural hinges with latching means engageable between the frame and the door side opposite the hingeably supported door side, comprising in combination:

an elongate flexible strap with first and second end having a first end portion rolled upon the first end to form an enlarged first end portion, said strap extending a spaced distance from the periphery of the enlarged first end portion to form a first loop side and being folded back upon itself to form an elongate loop, said second end portion passing back to the enlarged first end portion at the side opposite that from which the strap exited the first end portion and extending around a portion of the circumference of the enlarged first end portion and a spaced distance therepast, adjacent the first loop side, so that the second end portion will extend between adjacent edges of a door when closed and its supporting frame;

first fastening means in the loop portion spacedly adjacent the enlarged first end portion interconnecting the loop sides and second fastening means interconnecting the second end portion of the flexible strap to at least the first loop side; and coating material covering a portion of the outer peripheral surface of the flexible strap, extending from the enlarged first end portion strap, over the second end portion strap and a spaced distance therepast on the first loop side.

* * * * *